US007712162B2

(12) United States Patent
Shamie et al.

(10) Patent No.: US 7,712,162 B2
(45) Date of Patent: May 11, 2010

(54) BED FRAME SYSTEM CONVERTIBLE FROM A TODDLER FRAME TO A FULL OR TWIN SIZE FRAME, AND METHOD FOR CONVERTING THE SAME

(75) Inventors: Sam I. Shamie, Brooklyn, NY (US); Ely Louis Shamie, Brooklyn, NY (US)

(73) Assignee: Delta Enterprise Corp., New York, NY (US)

( * ) Notice: Subject to any disclaimer, the term of this patent is extended or adjusted under 35 U.S.C. 154(b) by 630 days.

(21) Appl. No.: 11/670,616

(22) Filed: Feb. 2, 2007

(65) Prior Publication Data

US 2008/0184485 A1 Aug. 7, 2008

(51) Int. Cl.
*A47D 7/01* (2006.01)
*A47C 19/04* (2006.01)

(52) U.S. Cl. ..... 5/2.1; 5/93.2; 5/53.1

(58) Field of Classification Search ..... 5/2.1, 5/53.1, 53.2, 53.3, 93.2, 201
See application file for complete search history.

(56) References Cited

U.S. PATENT DOCUMENTS 2,677,832 A * 5/1954 Christensen ..... 5/93.1
4,361,919 A * 12/1982 Hull ..... 5/93.2
4,450,597 A * 5/1984 Hull ..... 5/2.1
4,856,127 A * 8/1989 Lenger ..... 5/53.1
5,067,183 A * 11/1991 Urquiola ..... 5/2.1
5,077,846 A * 1/1992 Wheeler et al. ..... 5/93.2
5,146,631 A * 9/1992 Deal ..... 5/93.2
5,163,190 A * 11/1992 Hwang ..... 5/93.2
5,173,974 A * 12/1992 Proano et al. ..... 5/93.2
5,715,551 A * 2/1998 Proano et al. ..... 5/93.2
5,790,994 A * 8/1998 Leonard ..... 5/53.1
6,557,191 B2 * 5/2003 Bellows et al. ..... 5/200.1
6,845,530 B2 * 1/2005 Briere ..... 5/93.2
7,096,525 B2 * 8/2006 Briere ..... 5/93.2
2008/0184485 A1 * 8/2008 Shamie et al. ..... 5/2.1

* cited by examiner

*Primary Examiner*—Robert G Santos
(74) *Attorney, Agent, or Firm*—Richard M. Goldberg

(57) ABSTRACT

A toddler bed frame system is convertible for use with either a twin or full size bed, and includes a toddler side wall having detachable components for this purpose. A first supporting leg is connected to one end of the toddler side wall, and a toddler headboard is detachably and pivotally mounted about the first supporting leg. A second supporting leg is connected to the opposite end of the toddler side wall, and a toddler footboard is detachably and pivotally mounted about the second supporting leg. A third supporting leg is connected to the opposite end of the toddler headboard, and a side rail panel is detachably and pivotally mounted about the third supporting leg. A fourth supporting leg is connected at a free end of the side rail panel. A fifth supporting leg is connected at a free end of the toddler footboard.

25 Claims, 7 Drawing Sheets

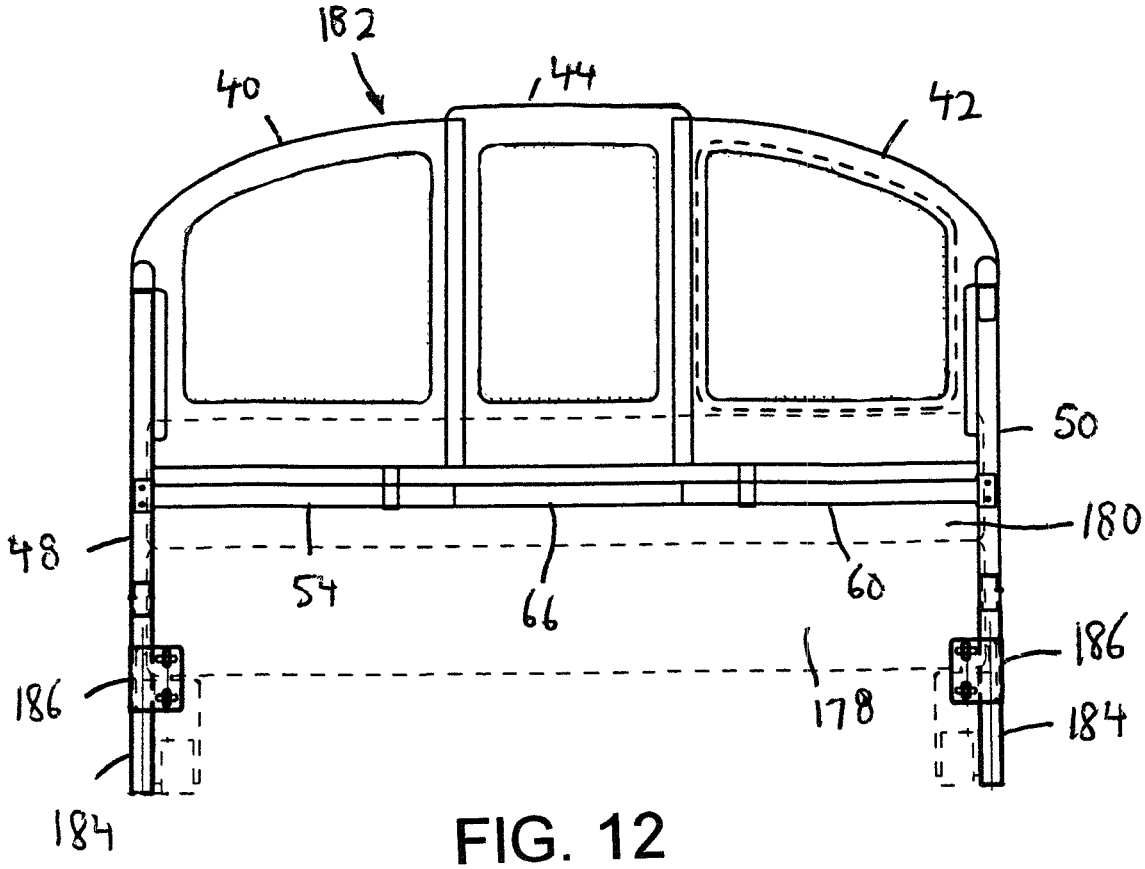
FIG. 12
FIG. 13
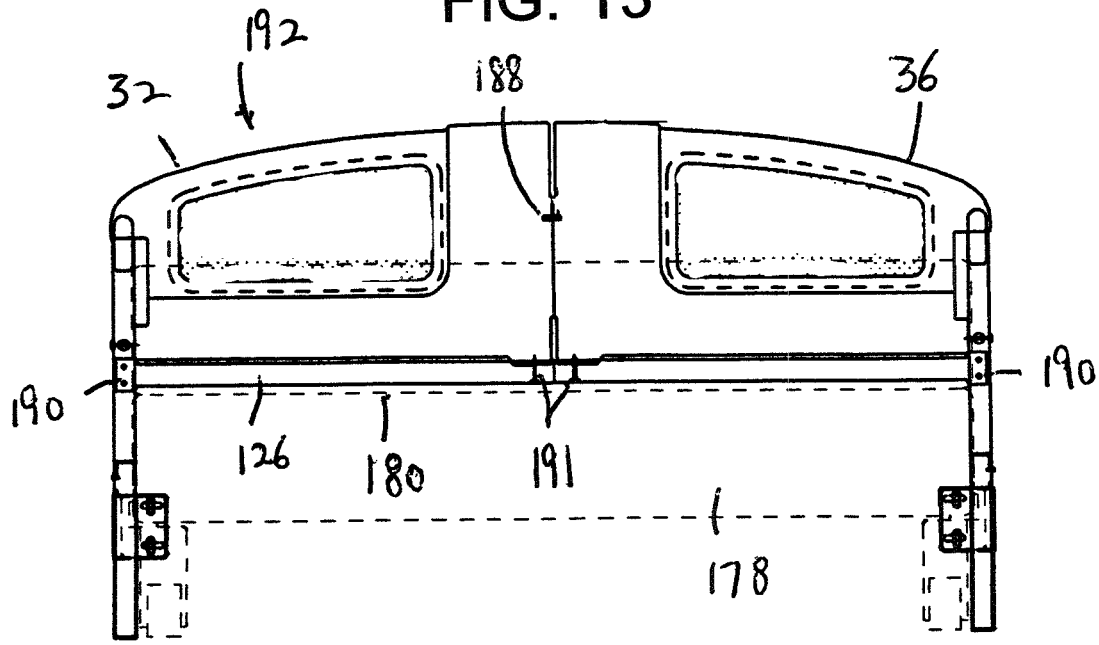

BED FRAME SYSTEM CONVERTIBLE FROM A TODDLER FRAME TO A FULL OR TWIN SIZE FRAME, AND METHOD FOR CONVERTING THE SAME

BACKGROUND OF THE INVENTION

The present invention relates generally to bed frame systems, and more particularly, to a bed frame system that can easily convert from a toddler bed frame to a twin or full size bed frame.

When a child becomes too large for a crib and/or is able to climb out of a crib, it becomes necessary to place a child in a bed. However, conventional twin and full size beds are often too big for a small child, and the change from a crib to a conventional twin or full size bed is often overwhelming to a small child.

For this reason, the child is often placed in a toddler bed, which is smaller than a conventional twin or full size bed. The toddler bed uses the same crib mattress to which the child has become accustomed, but is lower to the floor than a conventional twin or full size bed. The toddler bed is also equipped with a headboard and footboard, and may optionally include low safety side rail panels so that the child will stay snugly in bed. In such case, the side rail panels are attached to the headboard but only extend part of the way along the length of the bed, for example, one-half the length of the bed. This provides safety for the child so as to prevent the child from falling out of the bed, while also providing openings near the foot of the bed to allow the child to easily get out of the bed. Such a bed also makes the child feel grown up.

When the child gets older, for example, four to five years old, the child is then ready for a conventional twin or full size bed. In such case, the toddler bed is discarded and is replaced by a conventional twin or full size bed. This, however, results in additional costs, since the conventional twin or full size bed will also have a separate headboard and footboard, which are larger than that of the toddler bed, thereby further increasing the costs of purchasing a new bed.

SUMMARY OF THE INVENTION

Accordingly, it is an object of the present invention to provide a bed frame system that overcomes the aforementioned problems.

It is another object of the present invention to provide a bed frame system which can easily convert from a toddler bed to a conventional twin or full size bed.

It is yet another object of the present invention to provide a bed frame system that is easy to assemble and/or disassemble with respect to a toddler bed, a twin size bed and a full size bed.

In accordance with an aspect of the present invention, a toddler bed frame system convertible for use with at least one of a twin and full size bed, includes a toddler side wall convertible to a headboard for the twin and/or full size bed. The toddler side wall has a length substantially equal to a width of the twin or full size bed. A toddler headboard is adapted to be detachably connected to one end of the toddler side wall, and a first supporting leg is connected to one end of the toddler side wall at a juncture of the toddler side wall and one end of the toddler headboard. A second supporting leg is connected at an opposite end of the toddler side wall, and a third supporting leg is connected at the opposite end of the toddler headboard.

The toddler side wall includes a center section having opposite sides, a first outer section detachably connected to one of the sides of the center section, and a second outer section detachably connected to an opposite side of the center section. In this manner, the toddler side wall comprised of the connected center section, first outer section and second outer section is adapted to be used as a full size headboard for a full size bed, while the first outer section and the second outer section when detached from the center section are adapted to be connected together along inner ends thereof to be used as a twin size headboard for a twin size bed.

The toddler side wall includes a mattress support rail at a lower end thereof. Specifically, the first outer section includes a first mattress support rail at a lower end thereof, the second outer section includes a second mattress support rail at a lower end thereof and the center section includes a third mattress support rail at a lower end thereof. There is also a second mattress support rail at an opposite side of the bed frame system and connected with at least one of the third supporting leg and the headboard.

The first supporting leg is connected to an end of the first outer section and the second supporting leg is connected to an end of the second outer section. The first and second mattress support rails engage the third mattress support rail, the first mattress support rail is connected with the first supporting leg and the second mattress support rail is connected with the second supporting leg. A further supporting leg is connected to the center section, and the third mattress support rail is also connected with the further supporting leg.

Preferably, the first and second outer sections have upper edges that are inclined upwardly toward the center section.

There is also a connecting arrangement for connecting the full size headboard to a frame of the full size bed and a connecting arrangement for connecting the twin size headboard to a frame of the twin size bed.

The toddler headboard is pivotally mounted relative to the toddler side wall about an axis of the first supporting leg. In this regard, the first supporting leg is detachably connected to the one end of the toddler side wall, and the toddler headboard is removably mounted about the first supporting leg for pivoting movement relative to the toddler side wall about the axis of the first supporting leg.

The toddler bed frame system may optionally include a side rail panel adapted to be connected with an opposite end of the toddler headboard, with the third supporting leg connected at a juncture of the side rail panel and the opposite end of the toddler headboard, and a fourth supporting leg connected at a free end of the side rail panel.

In like manner, the side rail panel is pivotally mounted relative to the toddler headboard about an axis of the third supporting leg. The third supporting leg is detachably connected to the opposite end of the toddler headboard, and the side rail panel is removably mounted about the third supporting leg for pivoting movement relative to the toddler headboard about the axis of the third supporting leg.

In addition, the toddler bed frame system includes a toddler footboard adapted to be connected with the opposite end of the toddler side wall, with the second supporting leg connected at a juncture of the toddler side wall and the toddler footboard. A fifth supporting leg is connected at a free end of the toddler footboard. Specifically, the toddler footboard is pivotally mounted relative to the toddler side wall about an axis of the second supporting leg. The second supporting leg is detachably connected to the opposite end of the toddler side wall, and the toddler footboard is removably mounted about the second supporting leg for pivoting movement relative to the toddler side wall about the axis of the second supporting leg.

Preferably, each of the toddler footboard and the toddler headboard have an upper surface that is inclined upwardly toward the toddler side wall.

The toddler headboard and the toddler footboard are adapted to be connected together along inner ends thereof to be used as a full size footboard for the full size bed.

There is also a connecting arrangement for connecting the full size footboard to a frame of the full size bed.

In accordance with another aspect of the present invention, a method of converting a toddler bed frame system of the type described above to a headboard of a full size bed, includes the steps of detaching the toddler headboard from the toddler side wall, and mounting the toddler side wall to a frame of the full size bed as a full size headboard thereof. The method further includes the step of detaching the toddler footboard from the toddler side wall prior to the step of connecting.

In accordance with still another aspect of the present invention, a method of converting a toddler bed frame system of the type described above to a headboard of a twin size bed, includes the steps of detaching the toddler headboard from the toddler side wall, detaching the first outer section and the second outer section from the center section, connecting inner edges of the first outer section and the second outer section together, and mounting the connected together first outer section and second outer section to a frame of the twin size bed as a twin size headboard thereof. The method further includes the steps of detaching the toddler footboard from the toddler side wall prior to the step of connecting, connecting inner edges of the toddler headboard and the toddler footboard together, and mounting the connected together toddler headboard and toddler footboard to a frame of the full size bed as a full size headboard thereof.

The above and other features of the invention will become readily apparent from the following detailed description thereof which is to be read in connection with the accompanying drawings.

BRIEF DESCRIPTION OF THE DRAWINGS

FIG. 12 is an elevational view of the full bed of FIG. 11, viewed from the headboard side; and FIG. 13 is an elevational view of the full bed of FIG. 11, viewed from the footboard side.

DETAILED DESCRIPTION

Figure 1:
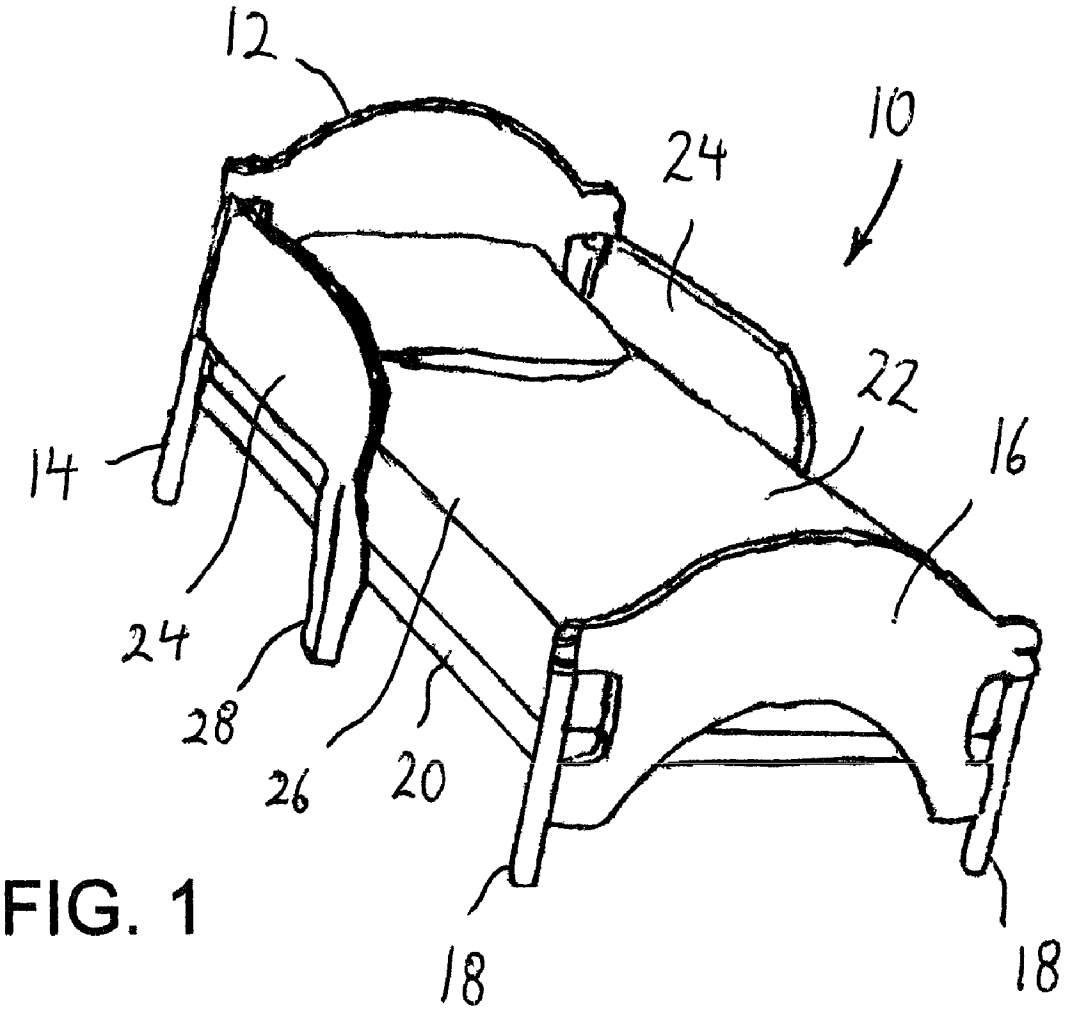
FIG. 1 PRIOR ART
FIG. 1 is a perspective view of a conventional toddler bed with a headboard, footboard and side rail panels.

Referring to the drawings in detail, and initially to FIG. 1 thereof, a conventional toddler bed 10 is shown which includes a headboard 12 having two downwardly extending headboard support legs 14 at opposite sides thereof. Only one such headboard support leg 14 is shown in FIG. 1. Toddler bed 10 further includes a footboard 16 having two downwardly extending footboard support legs 18 at opposite sides thereof. The spacing between headboard support legs 14 and the spacing between footboard support legs 18 are the same, and a mattress support frame 20 is connected between headboard support legs 14 and footboard support legs 18 for supporting a mattress 22 thereon.

Optionally, two side rail panels 24 may be connected to opposite sides, respectively, of headboard 12 and extend along the side of toddler bed 10, but only for part of the way along the length of the bed, for example, one-half the length of the bed. This provides safety for the child so as to prevent the child from falling out of the bed, while also providing opening areas 26 between the free ends of side rail panels 24 and footboard 16 to allow the child to easily get out of bed 10. Side rail panels 24 preferably each have a side rail supporting leg 28 at the free end thereof.

However, as discussed above, when the child gets older, for example, four to five years old, and is ready for a conventional twin or full size bed, the toddler bed must be discarded and replaced by a conventional twin or full size bed, resulting in additional costs, including the purchase of a new headboard and/or footboard.

Figures 2, 3, 4:
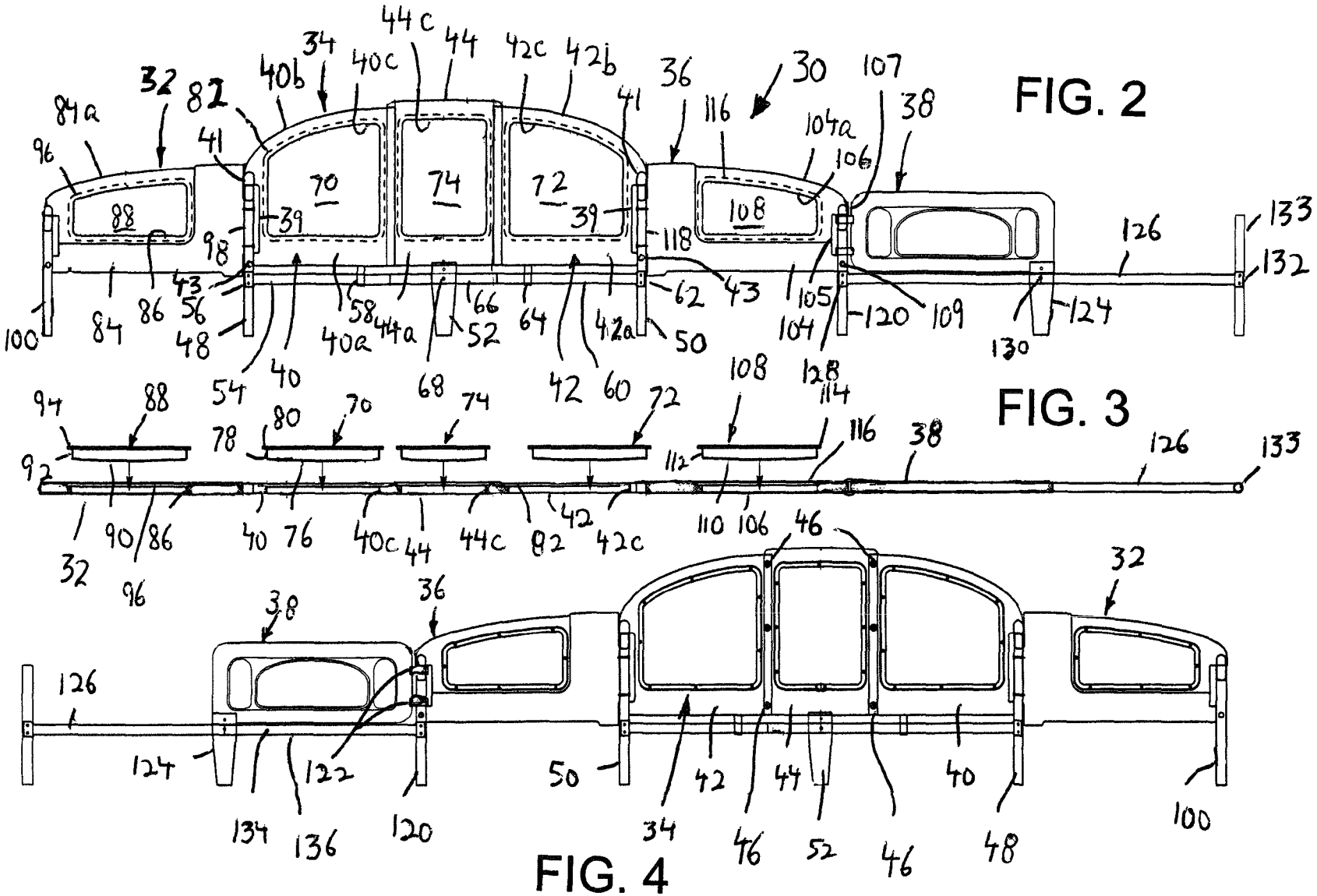
FIG. 2 is an unfolded front elevational view of a bed frame system according to the present invention.
FIG. 3 is a top plan view of the bed frame system of FIG. 2.
FIG. 4 is a rear elevational view of the bed frame system of FIG. 2.
Figure 5:
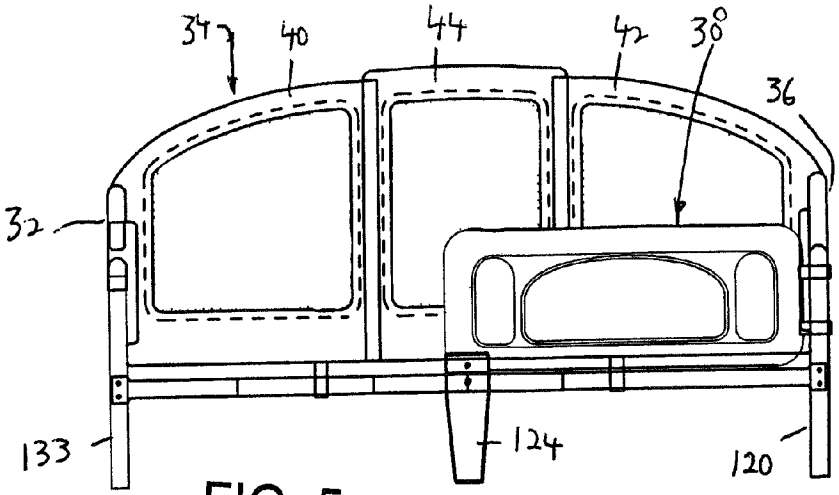
FIG. 5 is an elevational view of the bed frame system of FIG. 2 in a folded, operative condition, viewed from the open side thereof.
Figure 6:
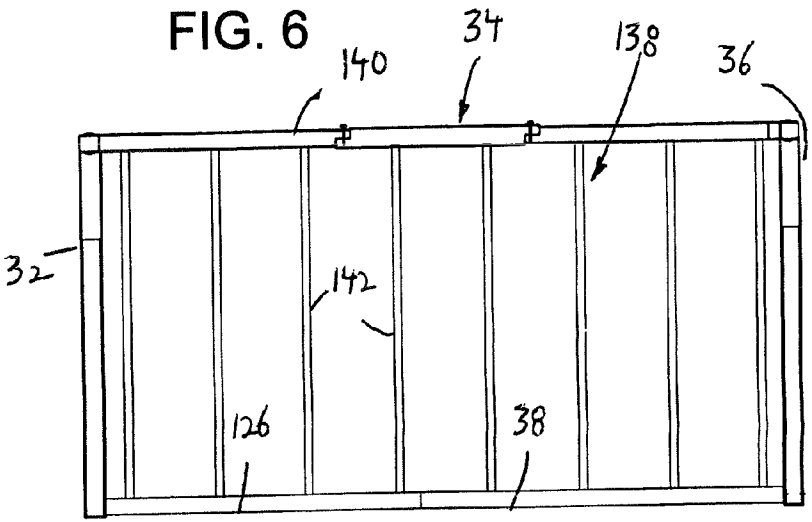
FIG. 6 is a top plan view of the folded bed frame system of FIG. 5.
Figure 7:
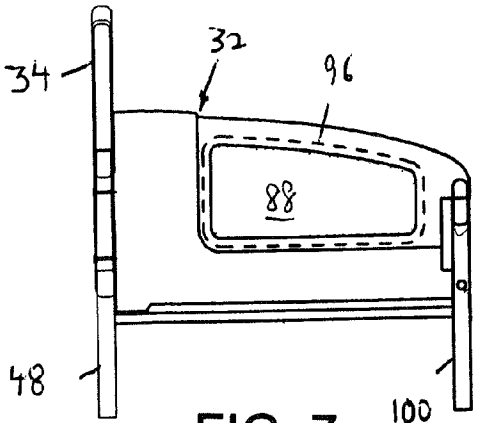
FIG. 7 is a side elevational view of the folded bed frame system of FIG. 5, viewed from the footboard side.
Figure 8:
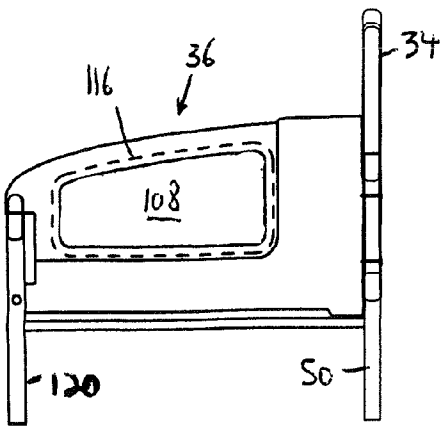
FIG. 8 is a side elevational view of the folded bed frame system of FIG. 5, viewed from the headboard side.

Referring now to FIGS. 2-8, a bed frame system 30 according to the present invention for a toddler bed is shown in an unfolded view in FIGS. 2-4 and in an assembled view in FIGS. 5-8. Bed frame system 30 includes, starting from the left side in FIG. 2, a toddler footboard 32, a toddler side wall 34 and a toddler headboard 36. An opposite toddler side rail panel or front fence 38 may optionally also be provided, but is not required with the present invention.

Side wall 34 is formed in three sections, namely, a first outer section 40, a second outer section 42 and a center section 44 interposed between and which connects together first outer section 40 and second outer section 42. In this regard, as shown best in FIG. 4, the inner side edge of first outer section 40 can overlap one side edge of center section 44, and removable bolts 46 can be inserted in overlapping openings thereof. In like manner, the inner side edge of second outer section 42 can overlap the opposite side edge of center section 44, and removable bolts 46 can be inserted in overlapping openings thereof.

First and second outer sections 40 and 42 and center section 44 each include a relatively flat, generally rectangular panel 40*a*, 42*a* and 44*a*, respectively, with the upper surfaces 40*b* and 42*b* of panels 40*a* and 42*a* sloping upwardly in a curved arc toward center section 44. A first outer section supporting leg 48 is connected to the free outer side edge of first outer section 40, and a second outer section supporting leg 50 is connected to the free outer side edge of second outer section 42, for providing support on a floor surface. In this regard, the free outer side edge of first outer section 40 and second outer section 42 each include a recess 39. The upper wall section defining the recess 39 of first outer section 40 and second outer section 42 each includes an opening 41 for receiving the upper end of each supporting leg 48 and 50, respectively, and each supporting leg 48 and 50 is removably connected to the lower wall section defining the recess 39 by a removable bolt 43. A center section supporting leg 52 extends down from the lower edge of center section 44, at the center thereof, for providing additional support on a floor surface.

In addition, a mattress support rail 54 is connected at one end by rivets, bolts or the like 56 to first outer section supporting leg 48 in a cantilevered manner below and parallel to the lower edge of first outer section 40. The free end of mattress support rail 54 is also connected by a bracket 58 to the lower edge of first outer section 40. In like manner, a mattress support rail 60 is connected at one end by rivets, bolts or the like 62 to second outer section supporting leg 50 in a cantilevered manner below and parallel to the lower edge of second outer section 42. The free end of mattress support rail 60 is also connected by a bracket 64 to the lower edge of second outer section 42. A mattress support rail 66 is connected at its center by rivets, bolts or the like 68 to center section supporting leg 52 below and parallel to the lower edge of center section 44. In this manner, when first outer section 40, second outer section 42 and center section 44 are connected together, mattress support rails 54 and 60 engage with mattress support rail 66 to provide continuity thereof, in order to support a crib mattress thereon.

In order to provide different decorative effects, each panel 40*a*, 42*a* and 44*a* is provided with a large central opening 40*c*, 42*c* and 44*c*, respectively, and a respective decorative insert panel 70, 72 and 74 is removably inserted in the respective large central opening. In this manner, the aesthetic appearance of each panel 40*a*, 42*a* and 44*a* can be easily changed. Preferably, each decorative insert panel 70, 72 and 74 is formed by a flat decorative section 76 having a surrounding side wall 78 extending perpendicular to decorative section 76 so that side wall 78 is friction fit within the respective large central opening 40*c*, 42*c* and 44*c*, and a flat circumferential section 80 is connected to the opposite end of side wall 78 for fitting in an outer recess 82 in surrounding relation to each large central opening 40*c*, 42*c* and 44*c*. Of course, any other means of securing each decorative insert 70, 72 and 74 in the respective large central opening 40*c*, 42*c* and 44*c*, can be provided. Each flat decorative section 76 is preferably formed as a padded insert on a medium density fiberboard (MDF), although the present invention is not limited thereby.

Footboard 32 includes a flat, generally rectangular panel 84 with a lower edge generally at the same height as mattress support rails 54, 60 and 66, and with an upper edge generally at the same height as the upper end of first outer section supporting leg 48. Preferably, as shown, the upper surface 84*a* of panel 84 has a gentle slope upwardly toward first outer section 40. In order to provide different decorative effects, panel 84 is provided with a large central opening 86 and a decorative insert panel 88 is removably inserted in large central opening 86. In this manner, the aesthetic appearance of panel 88 can be easily changed. Preferably, decorative insert panel 88 is formed by a flat decorative section 90 having a surrounding side wall 92 extending perpendicular to decorative section 90 so that side wall 92 can be friction fit within large central opening 86, and a flat circumferential section 94 is connected to the opposite end of side wall 92 for fitting in an outer recess 96 in surrounding relation to large central opening 86. Of course, any other means of securing decorative insert panel 88 in large central opening 86 can be provided. Flat decorative section 90 is preferably formed as a padded insert on a medium density fiberboard (MDF), although the present invention is not limited thereby.

Footboard 32 further includes a cylindrical bushing 98 at the side thereof corresponding to its greater height and which is mounted about first outer section supporting leg 48 to provide rotatable motion, and thereby to permit footboard 32 to pivot thereabout between the coplanar orientation with respect to first outer section 40, as shown in FIGS. 2-4, and a perpendicular orientation with respect to first outer section 40, as shown in FIGS. 5-8. Bushing 98 can be inserted over first outer section supporting leg 48 when supporting leg 48 is removed from first outer section 40 by removing bolt 43. When first outer section supporting leg 48 is secured again to first outer section 40, bushing 98 is positioned in recess 39 thereof. A footboard supporting leg 100 is connected to the free outer side edge of panel 84 of footboard 32 for providing further support on a floor surface.

Headboard 36, in like manner, includes a flat, generally rectangular panel 104 with a lower edge generally at the same height as mattress support rails 54, 60 and 66, and with an upper edge generally at the same height as the upper end of second outer section supporting leg 50. Preferably, as shown, the upper surface 104*a* of panel 104 has a gentle slope upwardly toward second outer section 42. In order to provide different decorative effects, panel 104 is provided with a large central opening 106 and a decorative insert panel 108 is removably inserted in large central opening 106. In this manner, the aesthetic appearance of panel 108 can be easily changed. Preferably, decorative insert panel 108 is formed by a flat decorative section 110 having a surrounding side wall 112 extending perpendicular to decorative section 110 so that side wall 112 can be friction fit within large central opening 106, and a flat circumferential section 114 is connected to the opposite end of side wall 112 for fitting in an outer recess 116 in surrounding relation to large central opening 106. Of course, any other means of securing decorative insert panel 108 in large central opening 106 can be provided. Flat decorative section 110 is preferably formed as a padded insert on a medium density fiberboard (MDF), although the present invention is not limited thereby.

Headboard 36 further includes a cylindrical bushing 118 at the side thereof corresponding to its greater height and which is mounted about second outer section supporting leg 50 to provide rotatable motion, and thereby to permit headboard 36 to pivot thereabout between the coplanar orientation with respect to second outer section 42, as shown in FIGS. 2-4, and a perpendicular orientation with respect to second outer section 42, as shown in FIGS. 5-8. Bushing 118 can be inserted over second outer section supporting leg 50 when supporting leg 50 is removed from second outer section 42 by removing bolt 43. When second outer section supporting leg 50 is secured again to second outer section 40, bushing 118 is positioned in recess 39 thereof.

A headboard supporting leg 120 is connected to the free outer side edge of panel 104 of headboard 36 for providing support on a floor surface. In this regard, the free outer side edge of headboard 36 includes a recess 105. The upper wall section defining the recess 105 of headboard 36 includes an opening 107 for receiving the upper end of headboard supporting leg 120, and headboard supporting leg 120 is removably connected to the lower wall section defining the recess 105 of headboard 36 by a removable bolt 109.

Side rail panel 38 is a rectangular panel having an upper edge at the same height as the upper edge of headboard 36 at the lower height end thereof, and a lower edge which is at the same height as the lower edge of headboard 36. Side rail panel 38 includes two cylindrical bushing grips 122 which are mounted about headboard supporting leg 120 to provide rotatable motion, and thereby to permit side rail panel 38 to pivot thereabout between the coplanar orientation with respect to headboard 36, as shown in FIGS. 2-4, and a perpendicular orientation with respect to headboard 36, as shown in FIGS. 5-8. Bushing grips 122 can be inserted over headboard supporting leg 120 when supporting leg 120 is removed from headboard 36 by removing bolt 109. When headboard supporting leg 120 is secured again to headboard 36, bushing grips 122 are positioned in recess 105 thereof. A side rail supporting leg 124 is connected to the free outer side edge of side rail panel 38 for providing support on a floor surface. Side rail supporting leg 124 corresponds to a standard toddler bed center leg support.

In addition, a mattress support rail 126 is connected at one end by rivets, bolts or the like 128 to headboard supporting leg 120 below and parallel to the lower edge of headboard 36 and side rail panel 38. Mattress support rail 126 has a length equal to the connected lengths of mattress support rails 54, 60 and 66. The midpoint of mattress support rail 126 is connected by rivets, bolts or the like 130 to side rail supporting leg 124. The free end of mattress support rail 126 is connected by rivets, bolts or the like 132 to a further supporting leg 133 that is adapted to be secured to footboard supporting leg 100 in order to provide a closed rectangular bed structure, as shown in FIGS. 5-8.

It will be appreciated that mattress support rails 54, 60, 66 and 126 each have an L-shaped cross-sectional profile, as shown in FIG. 4, so as to include a first segment 134 oriented in a vertical plane and a second segment 136 connected to the lower edge of first segment 134 and which extends inwardly of assembled bed frame system 30 in a horizontal orientation for holding a mattress support 138 (FIGS. 5-8) thereon. Mattress support 138 includes a rectangular frame 140 that seats on second segments 136 and is confined within first segments 134, and a plurality of slats 142 on which a crib mattress can be supported.

Figure 9:
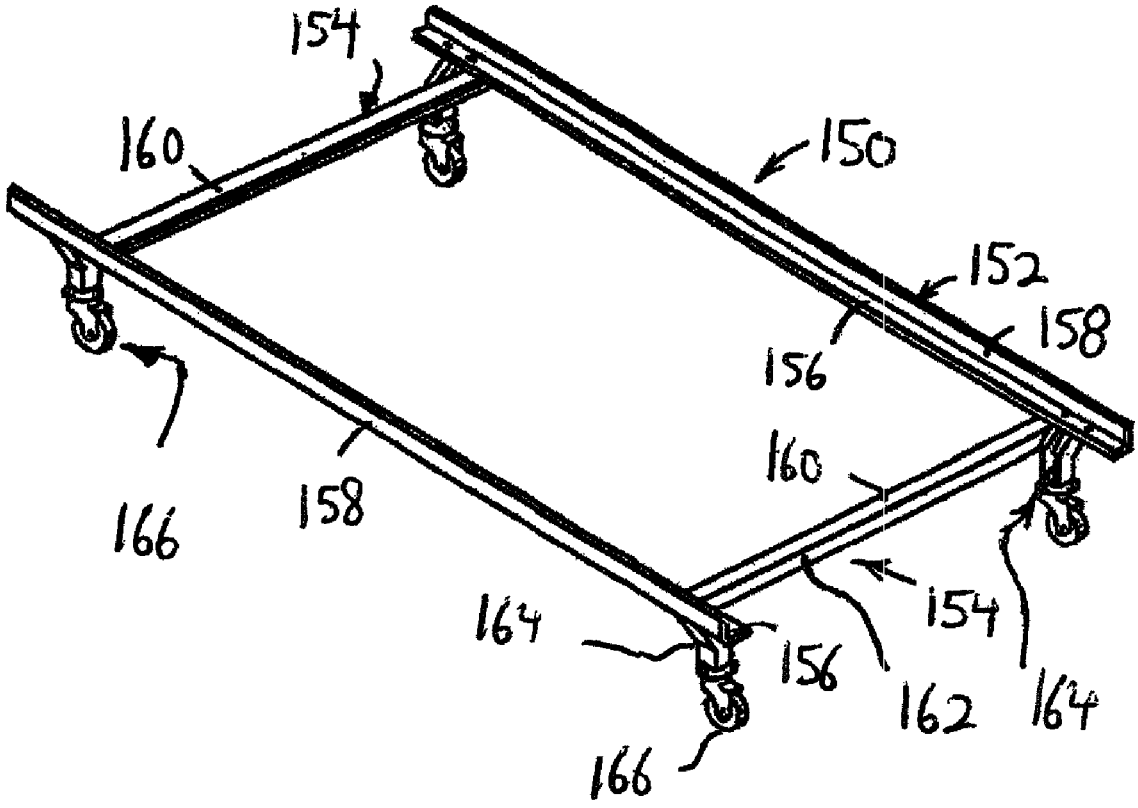
FIG. 9 PRIOR ART
FIG. 9 is a perspective view of a conventional bed frame for use with a twin or full size bed.

Referring now to FIG. 9, there is shown a conventional twin/full bed frame 150 comprising a pair of spaced parallel elongated side frame members 152 spanned by a pair of spaced parallel cross frame members 154 extending generally perpendicular with respect to side frame members 152. Cross frame members 154 may be of a conventional telescoping type. Side frame members 152 are each an elongated sheet metal or angle-iron member having an L-shaped cross-section with a horizontal inwardly facing coplanar leg portion 156 adapted to support a box spring and mattress on the upper surface thereof, and a generally vertically extending leg portion 158 adapted to confine the box spring and mattress on the coplanar leg portion 156.

Cross frame members 154 are also preferably each a sheet steel or angle-iron member having an L-shaped cross-section with a horizontal coplanar leg portion 160 and a downwardly extending vertical leg portion 162. Cross frame members 154 extend generally perpendicular with respect to side frame members 152, with horizontal coplanar portions 160 positioned immediately below horizontal leg portions 156 of frame members 152 when the frame is assembled.

Side frame members 152 are detachably secured to cross frame members 154 by connecting means in a manner well known in the art and a detailed description thereof is omitted from the present application. Frame 150 is supported above a floor surface by two pairs of leg assemblies 164 which are positioned at the ends of cross frame members 154 and which extend downwardly with respect to the longitudinal extent of side frame members 152. Each leg assembly 164 preferably includes a lockable wheel or roller 166 at the lower end thereof for support on a floor surface.

Figure 9A:
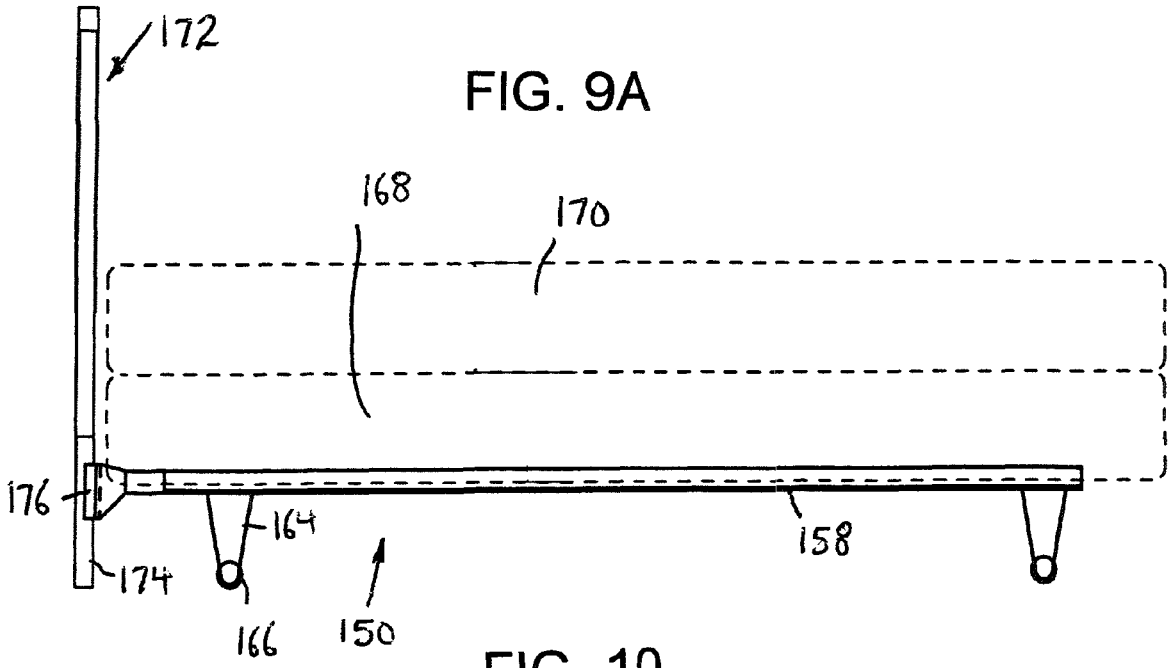
FIG. 9A is a side elevational view of a conventional twin bed using elements of the bed frame system of FIG. 5 as a headboard.
Figure 10:
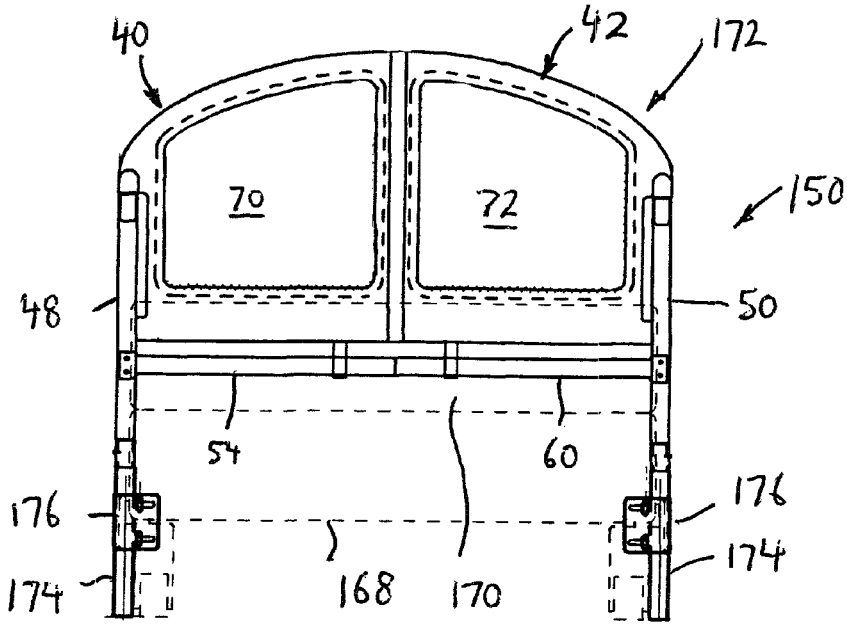
FIG. 10 is an elevational view of the twin bed of FIG. 9A, viewed from the headboard side.

As shown in FIGS. 9A and 10, toddler bed frame system 30 is adapted to be used with bed frame 150 of a twin bed size. Specifically, bed frame 150 is shown in FIGS. 9A and 10 with a box spring 168 and a mattress 170 thereon. In order to convert bed frame system 30 for use with conventional twin size bed frame 150, first outer section 40 and second outer section 42 of side wall 34 are detached from center section 44 thereof, by removing bolts 46. In addition, first outer section 40 is detached from footboard 32 by removing first outer section supporting leg 48 from first outer section 40 by removing the respective bolt 43, and then reattaching first outer section supporting leg 48 to first outer section 40 after bushing 98 has been removed therefrom. In like manner, second outer section 42 is detached from headboard 36 by removing second outer section supporting leg 50 from second outer section 42 by removing the respective bolt 43, and then reattaching second outer section supporting leg 50 to second outer section 42 after bushing 118 has been removed therefrom.

Thereafter, the inner side edge of first outer section 40 is made to overlap the inner side edge of second outer section 42, and removable bolts 46 can be inserted in overlapping openings thereof to secure first outer section 40 and second outer section 42 together. The connected structure forms a new twin size headboard 172 for twin size bed frame 150. It will be appreciated that, with new twin size headboard 172, mattress support rails 54 and 60 are engaged with each other.

In order to secure twin size headboard 172 to twin size bed frame 150, hollow cylindrical extension legs 174 are connected to one end of each side frame member 52 by mounting plates or brackets 176, and supporting legs 48 and 50 are removably inserted in hollow cylindrical extension legs 174.

With this arrangement, there is no need to purchase a separate twin size headboard when the child moves from a toddler bed to a twin size bed.

Figure 11:
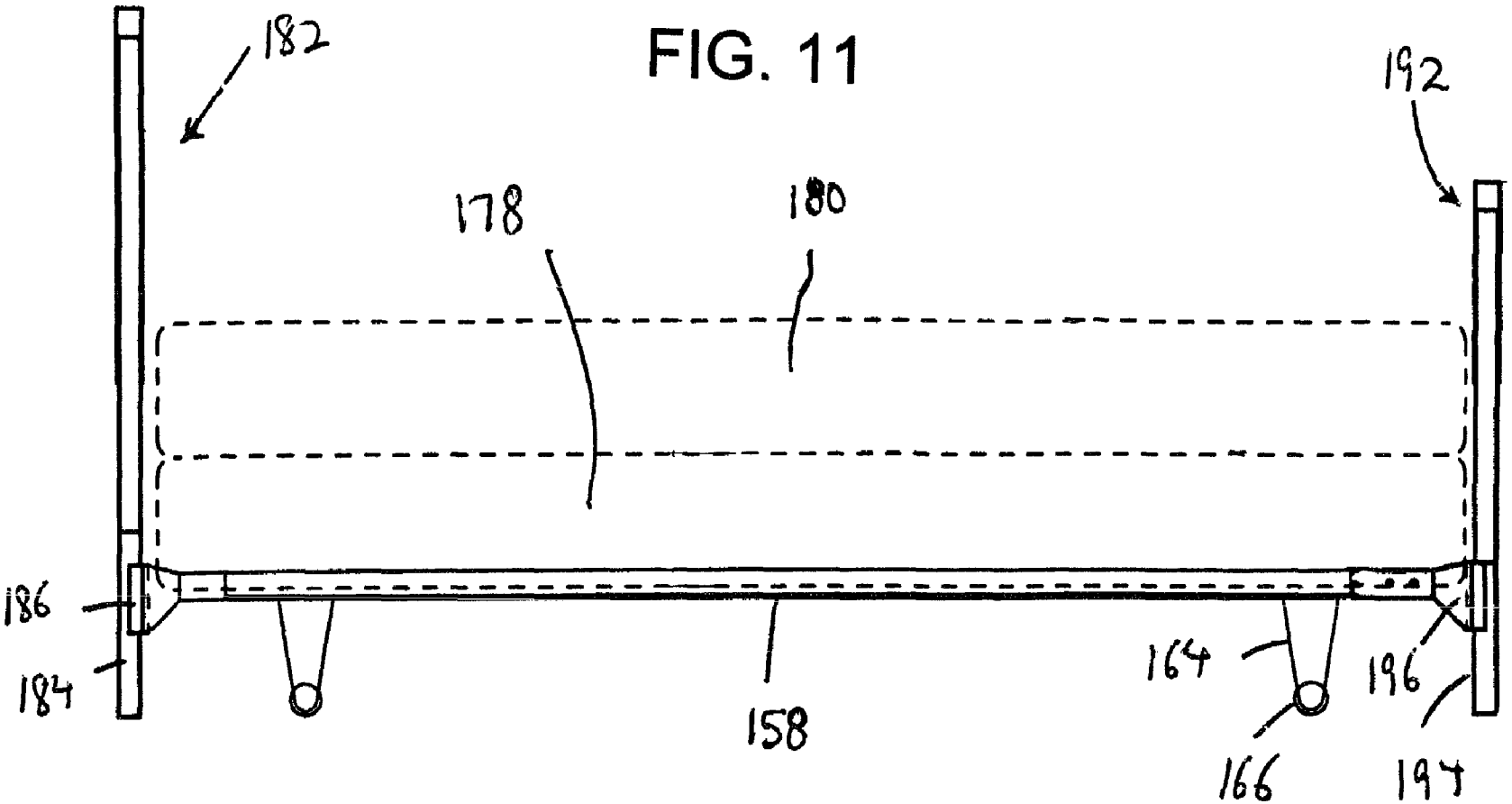
FIG. 11 is a side elevational view of a conventional full bed using elements of the bed frame system of FIG. 5 as a headboard and footboard.

In like manner, as shown in FIGS. 11-13, toddler bed frame system 30 is adapted to be used with bed frame 150 of a full bed size. Specifically, full size bed frame 150 is shown in FIGS. 11-13 with a box spring 178 and a mattress 180 thereon. In order to convert bed frame system 30 for use with conventional full size bed frame 150, first outer section 40 is detached from footboard 32 by removing first outer section supporting leg 48 from first outer section 40 by removing the respective bolt 43, and then reattaching first outer section supporting leg 48 to first outer section 40 after bushing 98 has been removed therefrom. In like manner, second outer section 42 is detached from headboard 36 by removing second outer section supporting leg 50 from second outer section 42 by removing the respective bolt 43, and then reattaching second outer section supporting leg 50 to second outer section 42 after bushing 118 has been removed therefrom. Thereafter, side wall 34 forms a new full size headboard 182 for full size bed frame 150.

In order to secure full size headboard 182 to full size bed frame 150, hollow cylindrical extension legs 184 are connected to one end of each side frame member 52 by mounting plates or brackets 186, and supporting legs 48 and 50 are removably inserted in hollow cylindrical extension legs 184.

Further, side rail panel 38 and side rail 126 are then detached from headboard 36. Specifically, side rail 126 is detached from headboard 36 by removing bolts 128. Side rail panel 38 is detached from headboard 36 by removing headboard supporting leg 120 from headboard 36 by removing the respective bolt 109, and then reattaching headboard supporting leg 120 to headboard 36 after cylindrical bushing grips 122 have been removed therefrom.

Thereafter, the inner side edge of footboard 32 is made to overlap the inner side edge of headboard 36, and a locator pin 188 can be inserted in respective openings thereof for holding footboard 32 and headboard 36 in a fixed relation. In addition, the removed side rail 126 is connected by bolts 190 to supporting legs 100 and 120 in order to retain footboard 32 and headboard 36 in a fixed relation. Locator screws 191 can be inserted through side rail 126 into footboard 32 and headboard 36 to further retain side rail 126 in position. The connected structure forms a new footboard 192 for full size bed frame 150.

In this regard, as shown in FIGS. 11-13, hollow cylindrical extension legs 194 are connected to the opposite end of each side-frame member 52 by mounting plates or brackets 196, and supporting legs 100 and 120 are removably inserted in hollow cylindrical extension legs 194.

With this arrangement, there is no need to purchase a separate footboard when the child moves from a toddler bed to a full size bed.

It will be appreciated that various modifications can be made to the present invention within the scope of the claims. For example, the dimensions of first outer section 40 and second outer section 42 can be increased to eliminate center section 44. In such case, bed frame system 30 would be convertible only to a full size bed. Also, in such case, first outer section 40 and second outer section 42 can be formed as a single integral section.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A toddler bed frame system convertible for use with at least one of a twin size bed and a full size bed, the toddler bed frame system comprising:

a toddler side wall convertible to a headboard for at least one of the twin size bed and the full size bed, the toddler side wall having a length substantially equal to a width of at least one of the twin size bed and the full size bed, a toddler headboard detachably connected to one end of the toddler side wall, a toddler footboard detachably connected with the opposite end of the toddler side wall, an arrangement for connecting together said toddler headboard and said toddler footboard after said toddler footboard and said toddler headboard have been detached from said toddler side wall, to form a footboard for the full size bed.

2. A toddler bed frame system according to claim 1, wherein said toddler side wall includes a first side mattress support rail at a lower end thereof, and further comprising:

supporting legs connected with said toddler headboard and toddler footboard, and a second mattress support rail at an opposite side of the bed frame system and connected at one end to at least one of:

said toddler headboard, and at least one supporting leg connected therewith, and at an opposite end to at least one of:

said toddler footboard, and at least one supporting leg connected therewith.

3. A toddler bed frame system according to claim 1, wherein each of said toddler footboard and said toddler headboard have an upper surface that is inclined upwardly toward said toddler side wall.

4. A toddler bed frame system according to claim 1, further comprising a connecting arrangement for connecting the full size footboard to a frame of the full size bed.

5. A method of converting a toddler bed frame system according to claim 1, to a headboard of a full size bed, the method comprising the steps of:

detaching the toddler headboard from the toddler side wall, and mounting the toddler side wall to a frame of the full size bed as a full size headboard thereof.

6. A method according to claim 5, wherein the method further comprises the step of detaching the toddler footboard from the toddler side wall prior to the step of mounting.

7. A toddler bed frame system according to claim 1, further comprising a first supporting leg connected to one end of said toddler side wall at a juncture of the toddler side wall and one end of the toddler headboard, a second supporting leg connected at an opposite end of said toddler side wall at a juncture of the toddler side wall and the toddler footboard, a third supporting leg connected at the opposite end of the toddler headboard, and a fourth supporting leg connected at the opposite end of the toddler footboard.

8. A toddler bed frame system according to claim 7, further comprising a side rail panel adapted to be connected with an opposite end of the toddler headboard, wherein the third supporting leg is connected at a juncture of the side rail panel and the opposite end of the toddler headboard, and further comprising a fifth supporting leg connected at a free end of said side rail panel.

9. A toddler bed frame system according to claim 7, wherein said toddler footboard is pivotally mounted relative to said toddler side wall about an axis of said second supporting leg.

10. A toddler bed frame system according to claim 9, wherein said second supporting leg is detachably connected to said opposite end of said toddler side wall, and said toddler footboard is removably mounted about said second supporting leg for pivoting movement relative to said toddler side wall about said axis of said second supporting leg.

11. A toddler bed frame system according to claim 1, further comprising a side rail panel having one end detachably connected with an opposite end of the toddler headboard.

12. A toddler bed frame system according to claim 11, wherein said side rail panel has a lengthwise dimension less than a lengthwise dimension of said toddler side wall, such that an opposite end of said side rail panel is spaced apart from the toddler footboard to provide an opening thereat.

13. A toddler bed frame system convertible for use with at least one of a twin size bed and a full size bed, the toddler bed frame system comprising:

a toddler side wall convertible to a headboard for either of the twin size bed and the full size bed, the toddler side wall having a length substantially equal to a width of at least one of the twin size bed and the full size bed, said toddler side wall extending in a lengthwise direction, and said toddler side wall includes:

a center section having opposite sides, a first outer section detachably connected to one of the sides of said center section, and a second outer section detachably connected to an opposite side of said center section, such that said toddler side wall extends in said lengthwise direction in the order of said first outer section, said center section and said second outer section, a toddler headboard adapted to be detachably connected to one end of the toddler side wall, said toddler side wall comprised of said connected center section, first outer section and second outer section is adapted to be used as a full size headboard for the full size bed, and said first outer section and said second outer section when detached from said center section are adapted to be connected together along inner ends thereof to be used as a twin size headboard for the twin size bed.

14. A toddler bed frame system according to claim 13, further comprising:

a first supporting leg connected to one end of said toddler side wall at a juncture of the toddler side wall and one end of the toddler headboard, a second supporting leg connected at an opposite end of said toddler side wall, a third supporting leg connected at the opposite end of the toddler headboard, and wherein said first supporting leg is connected to an end of said first outer section and said second supporting leg is connected to an end of said second outer section.

15. A toddler bed frame system according to claim 14, wherein said first outer section includes a first mattress support rail at a lower end thereof, said second outer section includes a second mattress support rail at a lower end thereof and said center section includes a third mattress support rail at a lower end thereof.

16. A toddler bed frame system according to claim 15, wherein said first and second mattress support rails engage said third mattress support rail, said first mattress support rail is connected with said first supporting leg and said second mattress support rail is connected with said second supporting leg.

17. A toddler bed frame system according to claim 16, further including a further supporting leg connected to said center section, and said third mattress support rail is connected with said further supporting leg.

18. A toddler bed frame system according to claim 13, wherein said first and second outer sections have upper edges that are inclined upwardly toward said center section.

19. A toddler bed frame system according to claim 13, further comprising at least one of the following:

a connecting arrangement for connecting the full size headboard to a frame of the full size bed, and a connecting arrangement for connecting the twin size headboard to a frame of the twin size bed.

20. A method of converting a toddler bed frame system according to claim 13 to a headboard of a twin size bed, the method comprising the steps of:

detaching the toddler headboard from the toddler side wall, detaching the first outer section and the second outer section from the center section, connecting inner edges of the first outer section and the second outer section together, and mounting the connected together first outer section and second outer section to a frame of the twin size bed as a twin size headboard thereof.

21. A method according to claim 20, wherein the toddler bed frame system further includes a toddler footboard connected with the opposite end of the toddler side wall, and the method further comprises the steps of:

detaching the toddler footboard from the toddler side wall prior to the step of connecting, connecting inner edges of the toddler headboard and the toddler footboard together, and mounting the connected together toddler headboard and toddler footboard to a frame of the full size bed as a full size footboard thereof.

22. A toddler bed frame system convertible for use with at least one of a twin size bed and a full size bed, the toddler bed frame system comprising:

a toddler side wall convertible to a headboard for at least one of the twin size bed and the full size bed, the toddler side wall having a length substantially equal to a width of at least one of the twin size bed and the full size bed, a toddler headboard adapted to be detachably connected to one end of the toddler side wall, a first supporting leg connected to one end of said toddler side wall at a juncture of the toddler side wall and one end of the toddler headboard, and said toddler headboard is pivotally mounted relative to said toddler side wall about an axis of said first supporting leg, a second supporting leg connected at an opposite end of said toddler side wall, and a third supporting leg connected at the opposite end of the toddler headboard.

23. A toddler bed frame system according to claim 22, wherein said first supporting leg is detachably connected to said one end of said toddler side wall, and said toddler headboard is removably mounted about said first supporting leg for pivoting movement relative to said toddler side wall about said axis of said first supporting leg.

24. A toddler bed frame system convertible for use with at least one of a twin size bed and a full size bed, the toddler bed frame system comprising:

a toddler side wall convertible to a headboard for at least one of the twin size bed and the full size bed, the toddler side wall having a length substantially equal to a width of at least one of the twin size bed and the full size bed, a toddler headboard adapted to be detachably connected to one end of the toddler side wall, a side rail panel adapted to be connected with an opposite end of the toddler headboard, a first supporting leg connected to one end of said toddler side wall at a juncture of the toddler side wall and one end of the toddler headboard, a second supporting leg connected at an opposite end of said toddler side wall, a third supporting leg connected at the opposite end of the toddler headboard at a juncture of the side rail panel and the opposite end of the toddler headboard, and said side rail panel is pivotally mounted relative to said toddler headboard about an axis of said third supporting leg, and a fourth supporting leg connected at a free end of said side rail panel.

25. A toddler bed frame system according to claim 24, wherein said third supporting leg is detachably connected to said opposite end of said toddler headboard, and said side rail panel is removably mounted about said third supporting leg for pivoting movement relative to said toddler headboard about said axis of said third supporting leg.

* * * * *